US007527447B2

(12) United States Patent
Huang

(10) Patent No.: US 7,527,447 B2
(45) Date of Patent: May 5, 2009

(54) MAGNETIC CAP FOR WRITING INSTRUMENT

(76) Inventor: Chin-Kuang Huang, 17, Lane 201, Kainan St., North District, Tainan City (TW)

( * ) Notice: Subject to any disclaimer, the term of this patent is extended or adjusted under 35 U.S.C. 154(b) by 0 days.

(21) Appl. No.: 11/728,941

(22) Filed: Mar. 27, 2007

(65) Prior Publication Data

US 2008/0240840 A1 Oct. 2, 2008

(51) Int. Cl.
*B43K 23/02* (2006.01)

(52) U.S. Cl. ..... 401/131

(58) Field of Classification Search ..... 401/98, 401/131, 202, 269, 195
See application file for complete search history.

(56) References Cited

U.S. PATENT DOCUMENTS 3,039,435 A * 6/1962 Meyer ..... 15/105.52
4,377,349 A * 3/1983 Kunii ..... 401/115
6,588,958 B1 * 7/2003 Seidler ..... 401/100
6,793,430 B1 * 9/2004 Liu ..... 401/131

* cited by examiner

*Primary Examiner*—Huyen Le
(74) *Attorney, Agent, or Firm*—Alan Kamrath; Kamrath & Associates PA

(57) ABSTRACT

A cap for a writing instrument includes a cap body having a peripheral wall formed with an elongated mounting recess, a retaining cover removably mounted in the mounting recess of the cap body, and a magnet mounted between the cap body and the retaining cover. Thus, the cap and the writing instrument are attached to the surface of a whiteboard or other metal by the magnetic force of the magnet, so that a user can use the writing instrument easily and conveniently, thereby facilitating the user using the writing instrument, and thereby preventing the writing instrument from being lost.

17 Claims, 4 Drawing Sheets

MAGNETIC CAP FOR WRITING INSTRUMENT

BACKGROUND OF THE INVENTION

1. Field of the Invention

The present invention relates to a cap and, more particularly, to a cap for a writing instrument, such as a marker, pen and the like.

2. Description of the Related Art

A conventional writing instrument, such as a marker, pen and the like, in accordance with the prior art shown in FIG. 6 comprises a barrel 10 and a cap 1 mounted on the barrel 10. Thus, such a writing instrument (the marker) is mainly available for a whiteboard. However, the writing instrument is easily lost unintentionally, so that a user has to find the writing instrument before use, thereby causing inconvenience to the user when using the writing instrument. In addition, when the writing instrument is placed on the bottom of the whiteboard, the writing instrument easily falls from the whiteboard, thereby causing inconvenience to the user when using the writing instrument.

BRIEF SUMMARY OF THE INVENTION

In accordance with the present invention, there is provided a cap, comprising a cap body having a peripheral wall formed with an elongated mounting recess, a retaining cover removably mounted in the mounting recess of the cap body, and a magnet mounted between the cap body and the retaining cover.

The primary objective of the present invention is to provide a magnetic cap for a writing instrument.

Another objective of the present invention is to provide a cap for a writing instrument, wherein the cap and the writing instrument are attached to the surface of the whiteboard or other metal by the magnetic force of the magnet, so that a user can use the writing instrument easily and conveniently, thereby facilitating the user using the writing instrument.

A further objective of the present invention is to provide a cap for a writing instrument, wherein the cap and the writing instrument are attached to the surface of the whiteboard or other metal by the magnetic force of the magnet, thereby preventing the writing instrument from being lost.

A further objective of the present invention is to provide a cap for a writing instrument, wherein the magnet is hidden between the cap body and the retaining cover so that the magnet will not directly contact the surface of the whiteboard, thereby preventing the surface of the whiteboard from being rubbed or worn by the magnet.

A further objective of the present invention is to provide a cap for a writing instrument, wherein the magnet is hidden between the cap body and the retaining cover to enhance the outer appearance of the cap.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
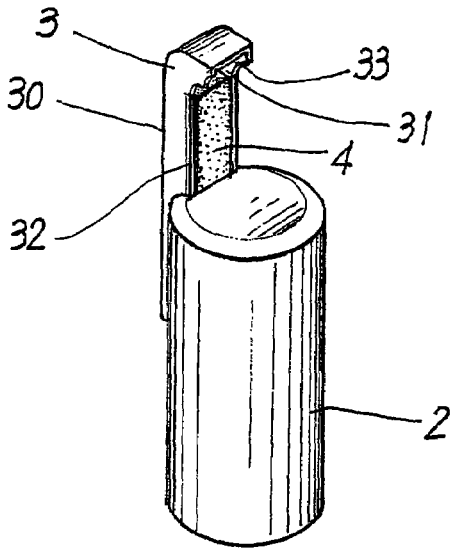
FIG. 1 is a perspective view of a cap in accordance with the preferred embodiment of the present invention.
Figure 3:
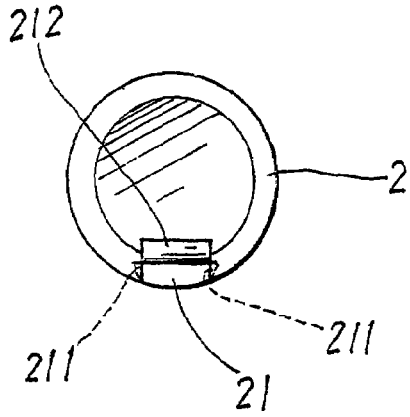
FIG. 3 is a top view of a cap body of the cap as shown in FIG. 1.
Figure 2:
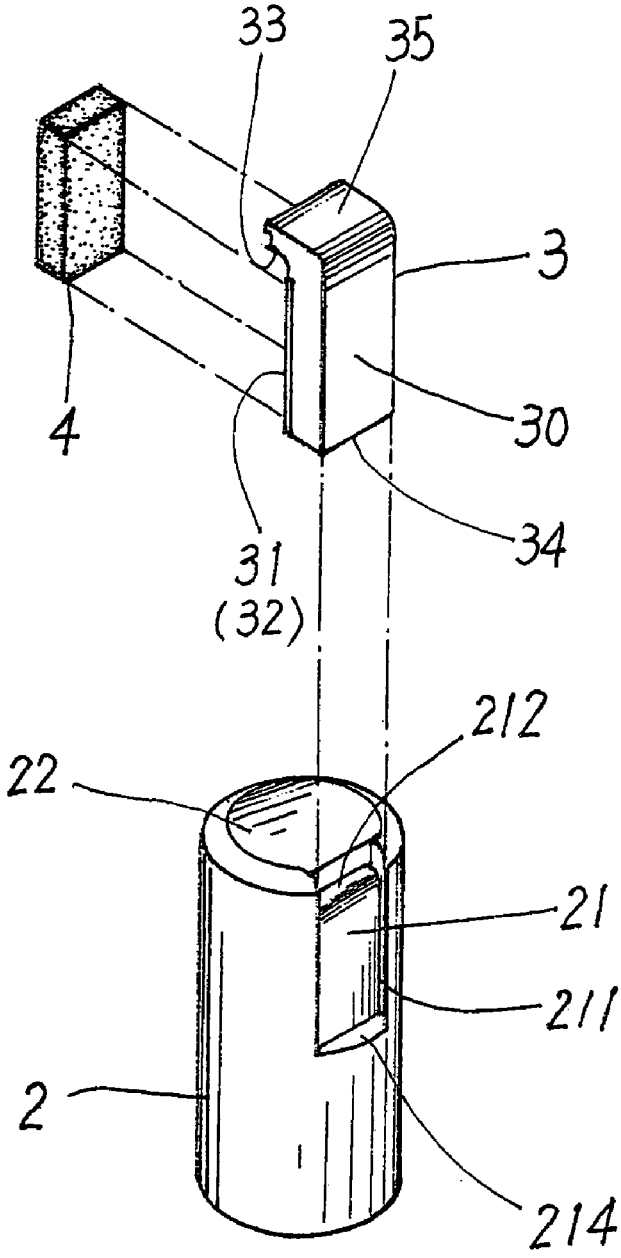
FIG. 2 is an exploded perspective view of the cap as shown in FIG. 1.

Referring to the drawings and initially to FIGS. 1-3, a cap for a writing instrument in accordance with the preferred embodiment of the present invention comprises a cap body 2 having a peripheral wall formed with an elongated mounting recess 21, a retaining cover 3 removably mounted in the mounting recess 21 of the cap body 2, and a magnet 4 mounted between the cap body 2 and the retaining cover 3.

The cap body 2 has two opposite ends and a mediate portion located between the two opposite ends. The mounting recess 21 of the cap body 2 extends in an axial direction of the cap body 2 and extends from one of the two opposite ends to the mediate portion of the cap body 2. The mounting recess 21 of the cap body 2 has a first end formed with a resting portion 212 and a second end formed with a resting section 214. The mounting recess 21 of the cap body 2 has two opposite sides each formed with an oblique locking groove 211 which extends in the axial direction of the cap body 2.

Figure 4:
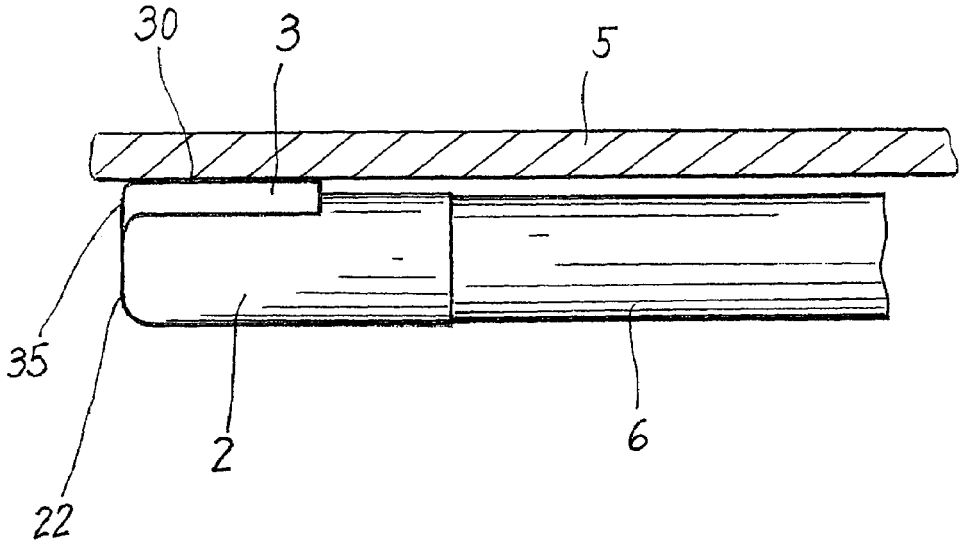
FIG. 4 is a schematic operational view of the cap as shown in FIG. 1 in use.

The retaining cover 3 is slidably inserted into and detachably mounted in the mounting recess 21 of the cap body 2. The retaining cover 3 is made of metallic material and has a first side formed with a receiving recess 31 facing the mounting recess 21 of the cap body 2 to receive the magnet 4 and a second side formed with an attachment portion 30 which has a smooth flat face and is located opposite to the receiving recess 31. The first side of the retaining cover 3 is slidably mounted and fully hidden in the mounting recess 21 of the cap body 2, and the attachment portion 30 of the retaining cover 3 protrudes outwardly from the cap body 2. The retaining cover 3 has a substantially L-shaped cross-sectional profile and has a first end formed with a protruding abutting portion 33 rested on the resting portion 212 of the cap body 2 and a second end formed with an abutting section 34 rested on the resting section 214 of the cap body 2. The retaining cover 3 seals the mounting recess 21 of the cap body 2, and the first end of the retaining cover 3 has an end face 35 flush with an end face 22 of one of the two opposite ends of the cap body 2 as shown in FIG. 4. The receiving recess 31 of the retaining cover 3 is located between the abutting portion 33 and the abutting section 34 and has two opposite sides each formed with a locking ramp 32 slidably inserted into and detachably locked in the respective locking groove 211 of the cap body 2. The receiving recess 31 of the retaining cover 3 extends in an axial direction of the retaining cover 3, and the locking ramp 32 of the retaining cover 3 also extends in the axial direction of the retaining cover 3.

The magnet 4 aligns with and is located opposite to the attachment portion 30 of the retaining cover 3. The magnet 4 is encompassed and fully hidden between the mounting recess 21 of the cap body 2 and the receiving recess 31 of the retaining cover 3.

In assembly, when the retaining cover 3 is slidably inserted into the mounting recess 21 of the cap body 2, the locking ramp 32 of the retaining cover 3 is slidably inserted into the respective locking groove 211 of the cap body 2 until the abutting portion 33 of the retaining cover 3 is rested on the resting portion 212 of the cap body 2, so that the retaining cover 3 is secured in the mounting recess 21 of the cap body 2.

Figure 5:
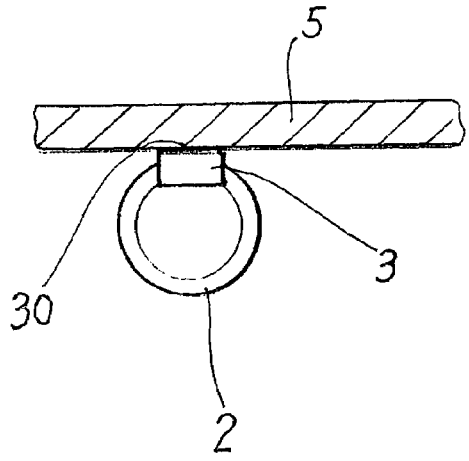
FIG. 5 is a schematic operational view of the cap as shown in FIG. 1 in use.
Figure 6:
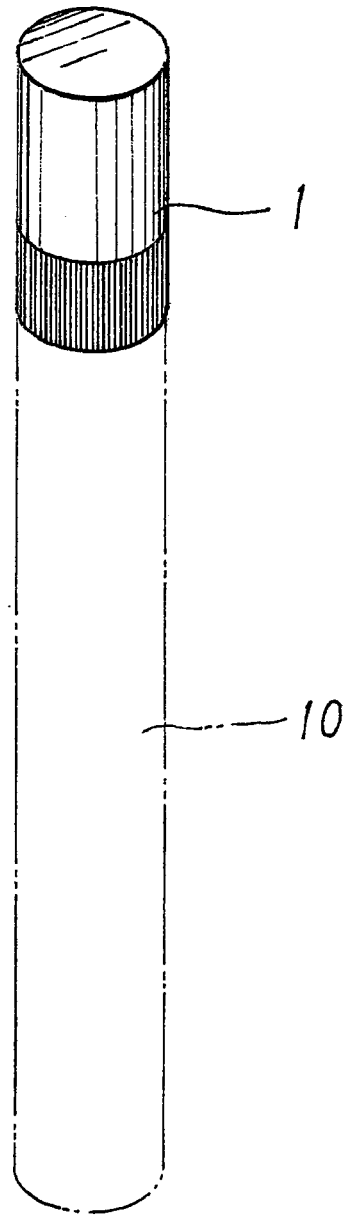
FIG.6 PRIOR ART
FIG. 6 is a perspective view of a conventional writing instrument in accordance with the prior art.

In operation, referring to FIGS. 4 and 5 with reference to FIGS. 1-3, the cap body 2 is mounted on a writing instrument 6, such as a marker, pen and the like. Thus, when the attachment portion 30 of the retaining cover 3 is rested on the surface of a metal or a whiteboard 5 made of a metallic material, the whiteboard 5 is attracted by the magnet 4 between the cap body 2 and the retaining cover 3 so that the attachment portion 30 of the retaining cover 3 is attached onto the surface of the whiteboard 5 by the magnetic force of the magnet 4 so as to attach the cap and the writing instrument 6 to the surface of the whiteboard 5.

Accordingly, the cap and the writing instrument 6 are attached to the surface of the whiteboard 5 or other metal by the magnetic force of the magnet 4, so that a user can use the writing instrument 6 easily and conveniently, thereby facilitating the user using the writing instrument 6. In addition, the cap and the writing instrument 6 are attached to the surface of the whiteboard 5 or other metal by the magnetic force of the magnet 4, thereby preventing the writing instrument 6 from being lost. Further, the magnet 4 is hidden between the cap body 2 and the retaining cover 3 so that the magnet 4 will not directly contact the surface of the whiteboard 5, thereby preventing the surface of the whiteboard 5 from being rubbed or worn by the magnet 4. Further, the magnet 4 is hidden between the cap body 2 and the retaining cover 3 to enhance the outer appearance of the cap.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A cap, comprising:

a cap body having a peripheral wall formed with an elongated mounting recess;

a retaining cover removably mounted in the mounting recess of the cap body;

a magnet mounted between the cap body and the retaining cover;

wherein the retaining cover has a first side formed with a receiving recess facing the mounting recess of the cap body to receive the magnet;

the mounting recess of the cap body has two opposite sides each formed with an oblique locking groove, and the receiving recess of the retaining cover has two opposite sides each formed with a locking ramp slidably inserted into and detachably locked in the respective locking groove of the cap body.

2. The cap in accordance with claim 1, wherein the locking groove of the cap body extends in an axial direction of the cap body.

3. The cap in accordance with claim 1, wherein the retaining cover has a second side formed with an attachment portion.

4. The cap in accordance with claim 3, wherein the attachment portion of the retaining cover has a smooth flat face.

5. The cap in accordance with claim 3, wherein the attachment portion of the retaining cover is located opposite to the receiving recess.

6. The cap in accordance with claim 3, wherein the magnet aligns with and is located opposite to the attachment portion of the retaining cover.

7. The cap in accordance with claim 3, wherein the first side of the retaining cover is slidably mounted and fully hidden in the mounting recess of the cap body, and the attachment portion of the retaining cover protrudes outwardly from the cap body.

8. The cap in accordance with claim 1, wherein the mounting recess of the cap body has a first end formed with a resting portion, and the retaining cover has a first end formed with a protruding abutting portion rested on the resting portion of the cap body.

9. The cap in accordance with claim 8, wherein the mounting recess of the cap body has a second end formed with a resting section, and the retaining cover has a second end formed with an abutting section rested on the resting section of the cap body.

10. The cap in accordance with claim 9, wherein the receiving recess of the retaining cover is located between the abutting portion of the retaining cover and the abutting section of the retaining cover.

11. The cap in accordance with claim 8, wherein the cap body has two opposite ends and a mediate portion located between the two opposite ends, and the mounting recess of the cap body extends from one of the two opposite ends to the mediate portion of the cap body.

12. The cap in accordance with claim 11, wherein the retaining cover seals the mounting recess of the cap body, and the first end of the retaining cover has an end face flush with an end face of one of the two opposite ends of the cap body.

13. The cap in accordance with claim 11, wherein the mounting recess of the cap body extends in an axial direction of the cap body.

14. The cap in accordance with claim 1, wherein the receiving recess of the retaining cover extends in an axial direction of the retaining cover.

15. The cap in accordance with claim 1, wherein the locking ramp of the retaining cover extends in the axial direction of the retaining cover.

16. The cap in accordance with claim 1, wherein the magnet is encompassed and fully hidden between the mounting recess of the cap body and the receiving recess of the retaining cover.

17. The cap in accordance with claim 1, wherein the retaining cover is slidably inserted into and detachably mounted in the mounting recess of the cap body.

* * * * *